US009739101B1

(12) United States Patent
Li

(10) Patent No.: US 9,739,101 B1
(45) Date of Patent: Aug. 22, 2017

(54) RISER DEFLECTION MITIGATION

(71) Applicant: Ensco International Incorporated, Wilmington, DE (US)

(72) Inventor: Wenzhi Li, Katy, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 15/209,146

(22) Filed: Jul. 13, 2016

(51) Int. Cl.
*E21B 17/01* (2006.01)
*E21B 19/00* (2006.01)
*E21B 33/035* (2006.01)

(52) U.S. Cl.
CPC ..... *E21B 17/017* (2013.01); *E21B 19/004* (2013.01); *E21B 33/035* (2013.01)

(58) Field of Classification Search
CPC .... E21B 17/017; E21B 19/004; E21B 33/035; E21B 17/01; E21B 19/006; B63B 35/4413
See application file for complete search history.

(56) References Cited

U.S. PATENT DOCUMENTS 3,010,214 A * 11/1961 Postlewaite ..... E21B 7/128 114/144 B
3,142,343 A * 7/1964 Otteman ..... E21B 19/24 166/355
3,265,130 A * 8/1966 Watkins ..... E21B 33/038 166/342
3,983,706 A * 10/1976 Kalinowski ..... E21B 19/004 166/355
4,244,663 A * 1/1981 Croghan ..... E21B 7/128 166/367
4,317,174 A * 2/1982 Dean ..... E21B 41/0014 114/264
4,436,451 A * 3/1984 Anderson ..... B63B 21/50 166/355
4,473,323 A * 9/1984 Gregory ..... B63B 21/50 114/265
4,576,516 A * 3/1986 Denison ..... B63B 35/4413 166/367
4,616,707 A * 10/1986 Langner ..... E21B 19/006 166/345
4,616,708 A * 10/1986 da Mota ..... E21B 19/09 166/355
4,617,998 A * 10/1986 Langner ..... E21B 19/09 166/345
4,708,525 A * 11/1987 Beynet ..... B63B 21/502 166/367
5,447,392 A * 9/1995 Marshall ..... E21B 19/006 405/202

(Continued)

FOREIGN PATENT DOCUMENTS

FR 3030667 A1 * 6/2016 ..... E21B 41/0007

*Primary Examiner* — Matthew R Buck
(74) *Attorney, Agent, or Firm* — Fletcher Yoder, P.C.

(57) ABSTRACT

Techniques and systems to reduce deflection of a riser extending from an offshore platform. A system may include a riser restraint device configured to be coupled to riser of an offshore platform. The system may also include a tether configured to be coupled to the riser restraint device. The system may further include a ratcheting system configured to be coupled to the tether, wherein the riser restraint device is configured to resist movement of the riser via selective retraction and extension of the tether from the ratcheting system.

19 Claims, 4 Drawing Sheets

(56) References Cited

U.S. PATENT DOCUMENTS

| | | | | | |
|---|---|---|---|---|---|
| 5,479,990 | A * | 1/1996 | Peppel | E21B 19/004 | 166/350 |
| 5,950,737 | A * | 9/1999 | Chou | E21B 17/01 | 166/355 |
| 5,978,739 | A * | 11/1999 | Stockton | E21B 19/002 | 701/116 |
| 6,343,655 | B1 * | 2/2002 | Thomas | E21B 7/043 | 166/339 |
| 7,080,689 | B2 * | 7/2006 | Guesnon | E21B 17/01 | 166/355 |
| 7,416,025 | B2 * | 8/2008 | Bhat | B63B 21/502 | 166/350 |
| 8,439,109 | B2 * | 5/2013 | Sbordone | E21B 47/0001 | 166/250.01 |
| 9,080,393 | B2 * | 7/2015 | Wishahy | E21B 17/01 | |
| 9,562,399 | B2 * | 2/2017 | Pollack | E21B 17/012 | |
| 2009/0056936 | A1 * | 3/2009 | McCoy, Jr. | E21B 19/002 | 166/250.01 |
| 2009/0212092 | A1 * | 8/2009 | Stol | B23K 20/12 | 228/112.1 |
| 2011/0290499 | A1 * | 12/2011 | Petegem | B63B 25/28 | 166/350 |
| 2014/0374117 | A1 * | 12/2014 | Aune | E21B 17/01 | 166/345 |
| 2016/0201407 | A1 * | 7/2016 | Haugom | E21B 41/04 | 166/367 |
| 2016/0251911 | A1 * | 9/2016 | Hallai | E21B 19/004 | |
| 2016/0298397 | A1 * | 10/2016 | Roper | E21B 17/017 | |

* cited by examiner

RISER DEFLECTION MITIGATION

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. To drill for oil and gas offshore, it is desirable to have stable offshore platforms and/or floating vessels from which to drill and recover the energy resources. Techniques to stabilize the offshore platforms and floating vessels include, for example, the use of mooring systems and/or dynamic positioning systems. However, these systems may not always adequately stabilize components descending from the offshore platforms and floating vessels to the seafloor wellhead.

For example, a riser string or riser (e.g., a pipe or series of pipes that connects the offshore platforms or floating vessels to the floor of the sea) may be used to transport drill pipe, casing, drilling mud, production materials or hydrocarbons between the offshore platform or floating vessel and a wellhead. The riser is suspended between the offshore platform or floating vessel and the wellhead, and may experience forces, such as underwater currents, that cause deflection (e.g., bending or movement) in the riser. Acceptable deflection can be measured by the deflection along the riser, and also at, for example, select points along the riser. These points may be located, for example, at the offshore platform or floating vessel and at the wellhead. If the deflection resulting from underwater current is too great, drilling must cease and the drilling location or reservoir may not be accessible due to such technological constraints.

DETAILED DESCRIPTION

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Systems and techniques for stabilizing a riser (e.g., a riser string) extending from offshore platform, such as a drillship, a semi-submersible platform, a floating production system, or the like, are set forth below. In one embodiment, a line is anchored to the riser via an anchor point. The line may also be tethered to one or more winches on the offshore platform and through controlled deployment and retraction of the line via the one or more winches, the deflection of the riser may be adjusted. In this manner, through control of the amount of length of the line disposed between the anchor point and the one or more winches, deflections of the riser may be reduced.

Figure 1:
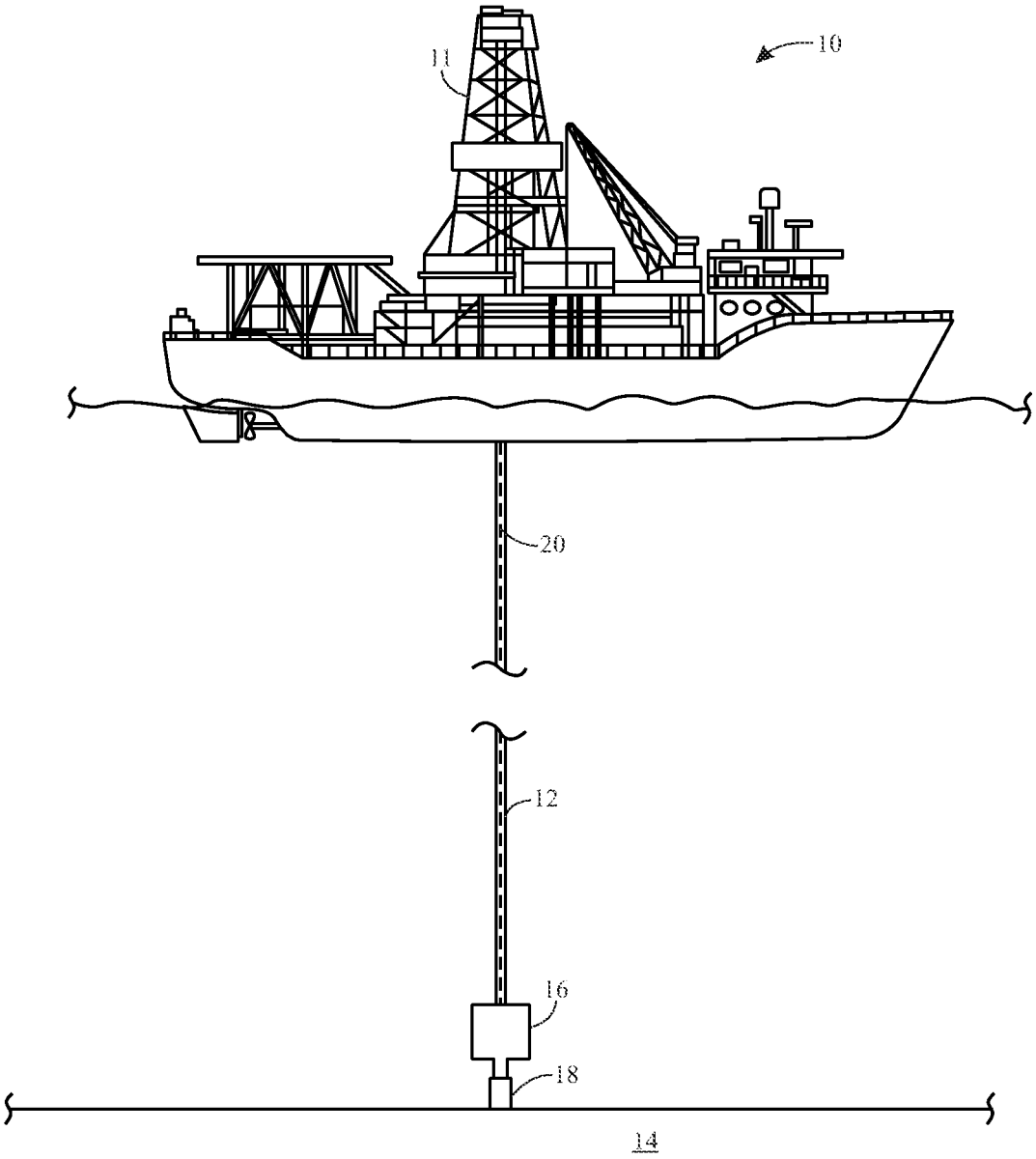
FIG. 1 illustrates an example of an offshore platform having a riser.

With the foregoing in mind, FIG. 1 illustrates an offshore platform comprising a offshore vessel 10. Although the presently illustrated embodiment of an offshore vessel 10 is a drillship (e.g., a ship equipped with a drill rig and engaged in offshore oil and gas exploration and/or well maintenance or completion work including, but not limited to, casing and tubing installation, subsea tree installations, and well capping), other offshore platforms such as a semi-submersible platform, a floating production system, or the like may be substituted for the drillship. Indeed, while the techniques and systems described below are described in conjunction with a drillship, the techniques and systems are intended to cover at least the additional offshore platforms described above.

As illustrated in FIG. 1, the offshore vessel 10 includes, having a derrick 11 thereon, includes a riser 12 extending therefrom. The riser 12 may include a pipe or a series of pipes (e.g., riser segments) that connect the offshore vessel 10 to the seafloor 14 via, for example, blow out preventer (BOP) 16 that is coupled to a wellhead 18 on the seafloor 14. In some embodiments, the riser 12 may transport produced hydrocarbons and/or production materials between the offshore vessel 10 and the wellhead 18, while the BOP 16 may include at least one valve with a sealing element to control wellbore fluid flows. In some embodiments, the riser 12 may pass through an opening (e.g., a moonpool) in the offshore vessel 10 and may be coupled to drilling equipment of the offshore vessel 10. As illustrated in FIG. 1, it may be desirable to have the riser 12 positioned in a vertical orientation between the wellhead 18 and the offshore vessel 10. However, external factors (e.g., environmental factors such as currents) may disturb the vertical orientation of the riser 12.

Figure 2:
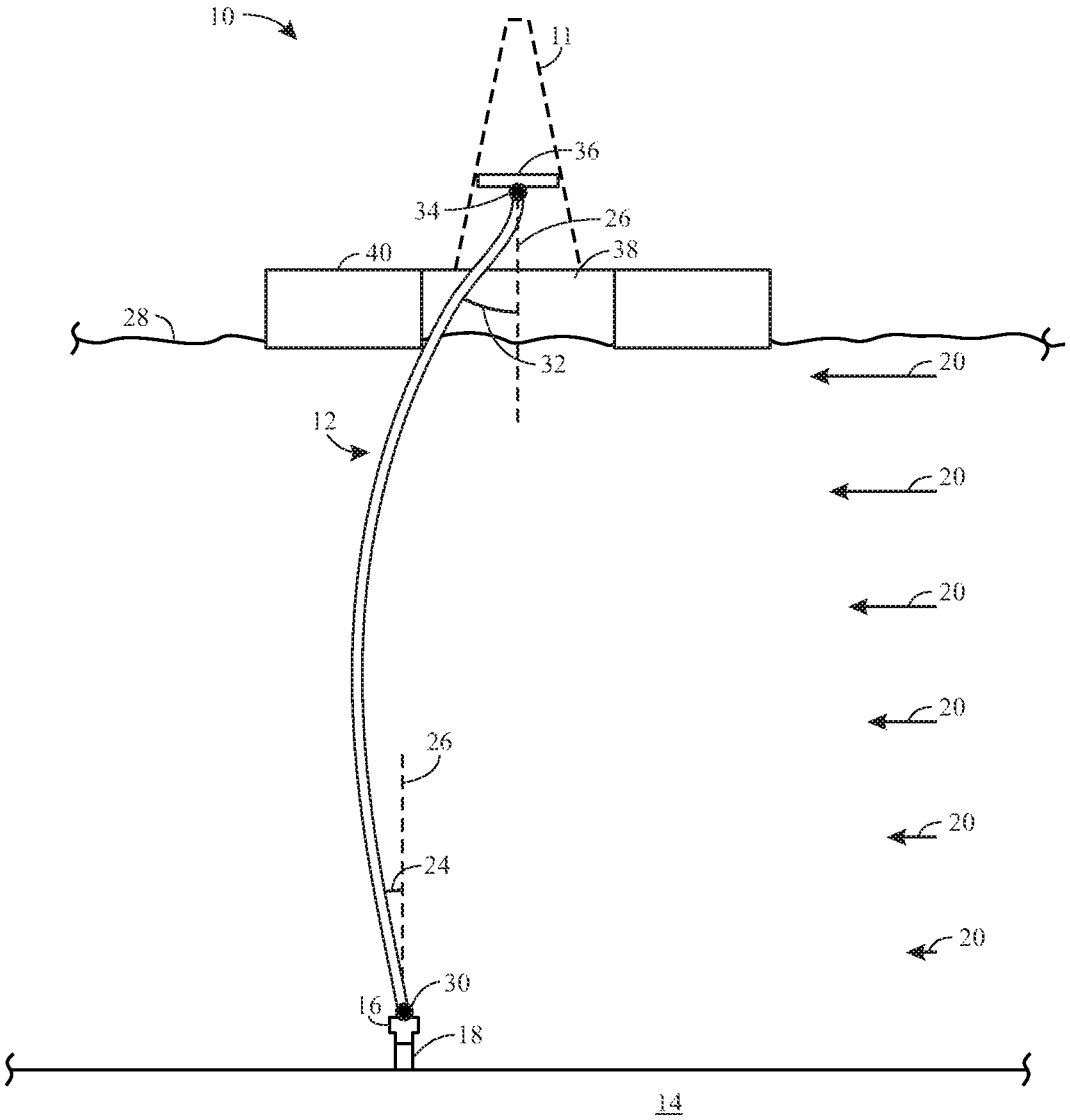
FIG. 2 illustrates an example of the offshore platform of FIG. 1 having a riser experiencing deflection.

As illustrated in FIG. 2, the riser 12 may experience deflection, for example, from currents 20. These currents 20 may apply forces on the riser 12, which causes deflection (e.g., motion, bending, or the like) in riser 12. Thus, when the offshore vessel 10 works under the existence of strong currents 20, the riser 12 will have significant horizontal deflection due to the drag loads applied along the riser 12.

As a result, the angle 24 between the vertical axis 26 (e.g., an axis of 90° between the seafloor 14 and the surface of the sea 28) of the riser bottom flex joint 30 may exceed tolerance levels for the performance of, for example, drilling operations.

This angle 24 may be modified through the dynamic positioning of the offshore vessel 10. That is, through the movement of the offshore vessel 10 in response to the currents 20, the static angle 24 of the bottom flex joint 30 may be reduced and/or eliminated to meet any operational requirements associated with, for example, the blow out preventer 16, the wellhead 18, and/or the riser 12. However, adjustment of the position of the offshore vessel 10 to reduce and/or eliminate the static angle 24 of the bottom flex joint 30 may also increase the the angle 32 of top flex joint 34 beneath drill floor 36 with respect to the vertical axis 26. This may cause the portion of the riser 12 beneath the drill floor as it passes through the moonpool 38 to interfere with the hull 40 of the offshore vessel 10. This interference between the riser 12 and the hull 40 is to be avoided.

Thus, force applied to the riser 12 from the currents 20 (or other environmental forces) other may cause the riser 12 to stress the BOP 16 or cause key seating, as the angle 24 that the riser 12 contacts the BOP 16 may be affected via the deflection of the riser 12. Likewise, the currents 20 and/or efforts to mitigate the force of the currents 20 (e.g., dynamic positioning of the offshore vessel) may cause the riser 12 to contact the edge of the moonpool 38 of the offshore vessel 10. To reduce the deflection of the riser 12, and to reduce the chances of occurrence of the aforementioned problems caused by riser 12 deflection, additional systems and techniques may be employed.

Figure 3:
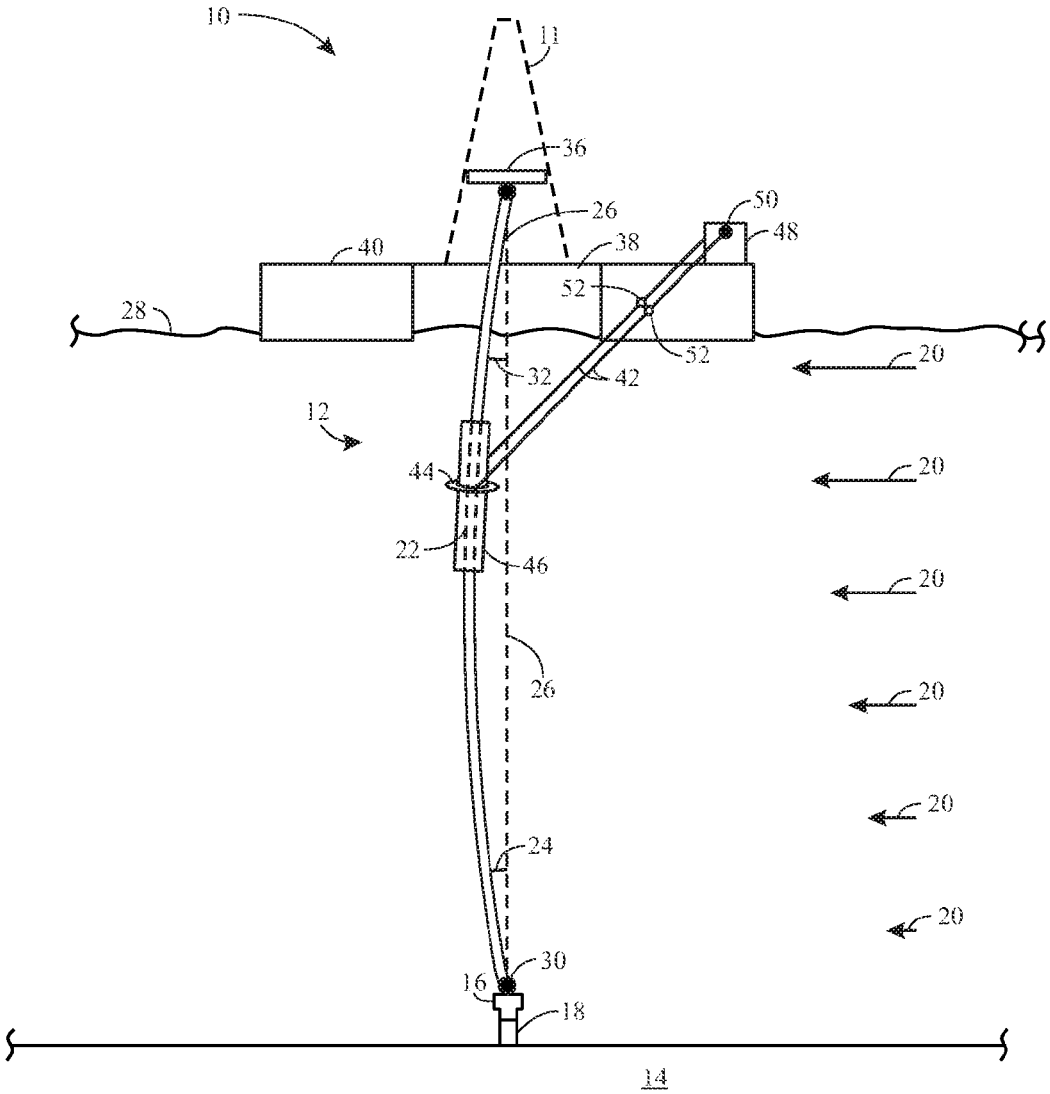
FIG. 3 illustrates a first embodiment of a system to mitigate the deflection of the riser of FIG. 2.

FIG. 3 illustrates a system to mitigate the deflection of the riser 12. In some embodiments, measurements may be made relating to the angle 24 of the riser 12 with respect to the BOP 16 and the angle 32 of the riser 12 with respect to a rig on the offshore vessel 10. Deflection of the riser 12 should be reduced to maintain these angles 24, 32 in a predetermined range, for example, within approximately 10° of the vertical axis 26 for angle 24 and/or within approximately 15° of the vertical axis 26 for angle 32. To help reduce the deflection, and to maintain the aforementioned angles 24, 32 in a predetermined range, a tension system may be employed. For example, one or more tethers 42 may be coupled to a specialized riser segment 22, for example, to a riser restraint device 44 of the riser segment. This riser restraint device 44 may be a ring, cylinder, or similar device that may circumscribe a particular riser segment 22. The riser restraint device 44 may be permanently affixed (e.g., welded to) the riser segment 22 or the riser restraint device 44 may be detachable from the riser segment 22 via one or more fasteners (bolts, or the like). In some embodiments, the riser segment 22 and/or the riser restraint device 44 coupled thereto may be positioned at a predetermined depth below the bottom of the hull 40.

As previously noted, one or more tethers 42 may be coupled to the riser restraint device 44. Each tether 42 may be composed of metal or of another minimally deformable material to control the horizontal position of the riser restraint device 44 about point 46 when coupled to ratcheting system 48. Likewise, each tether 42 may be composed of, for example, steel rope, nylon rope or a similar material and may operate similarly to control the horizontal position of the riser restraint device 44 when coupled to the ratcheting system 48. In some embodiments, the ratcheting system 48 may operate to control the horizontal position of the riser restraint device 44 about point 46 and, thus, the bottom angle 24, top angle 32 and moonpool 38 interface to meet respective operational requirements.

In this manner, the riser restraint device 44 may serve as a resistance point for the riser segment 22 and, thus, the riser 12, thereby limiting downstream deflections (e.g., limiting the deflection of the riser 12 to the predetermined amount of movement of the riser restraint device 44). In some embodiments, each tether 42 may be adjustable in length. For example, the ratcheting system 48 may include an extension and retraction mechanism 50 that may operate to extend or retract each tether 42 in response to external forces, such as currents 20 and/or in response to control commands. This extension and retraction mechanism 50 may be, for example, a constant tension winch, a hydraulic device similar to a riser tensioner, or another type of winch. The use extension and retraction mechanism 50 may allow for specified tension to be applied to the tethers 42.

The one or more tethers 42 may be coupled to a single ratcheting system 48 or each tether 42 may be coupled to respective single ratcheting system 48. The tethers 42 may pass through one or more fairleads 52 that operate to guide the tethers 42 while reducing and/or restricting lateral movement of the tethers 42. The one or more fairleads 52 may include a mechanical device, such as a ring, a hook, or the like or the one or more fairleads 52 may be an aperture in the hull 40 of the offshore vessel 10. In some embodiments, the ratcheting system 48 may operate in response to measured changes in the environment, including weather changes, and may readjust tension of the one or more tethers 42 in response to the measured changes. Furthermore, during conditions (e.g., adverse weather conditions) that may require removal of the riser 12, the ratcheting system 48 may generally release the tension in the tethers 42 to provide slack for disconnection of the tethers 42 either in the sea 28 (e.g., via a remotely operated vehicle, via acoustic or other wireless signals, via a hardwired connection, or the like) or as the riser segment 22 is being broken out on the offshore vessel 10.

Figure 4:
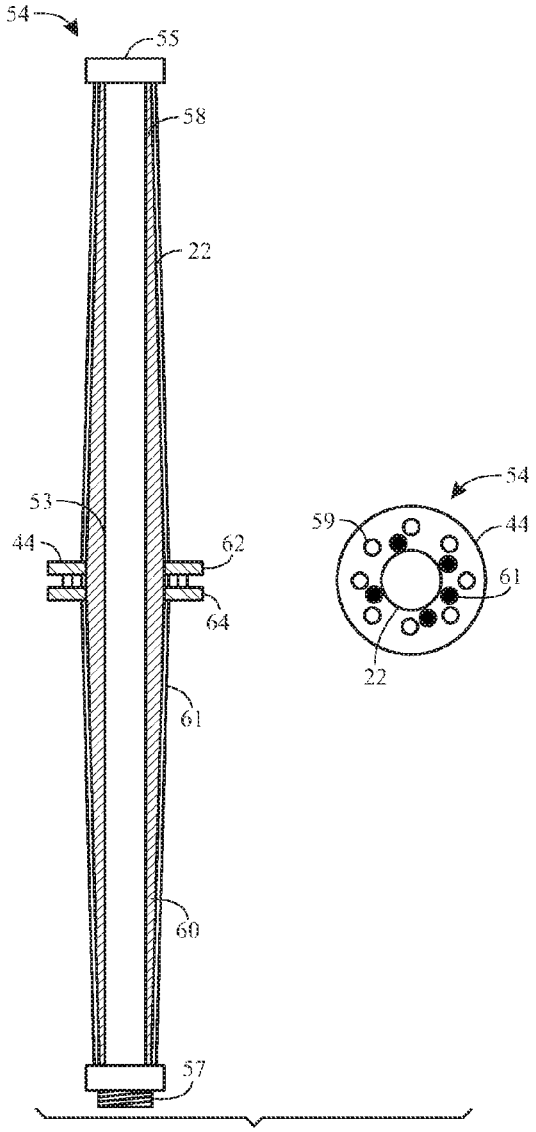
FIG. 4 illustrates a top and a side view of a riser restraint device of FIG. 3.

FIG. 4 illustrates a side view 54 and a top view 56 of the riser segment 22 having the riser restraint device 44. The riser segment 22 of FIG. 4 may be a particular riser joint that is physically distinct from the remaining riser segments 22 of FIGS. 2 and 3. For example, the riser segment 22 may be shaped in a manner that reduces and/or eliminates possible stress concentrations due to pulling loads. For example, the middle portion 53 of the riser segment 22 (e.g., the portion adjacent the riser restraint device 44) may be thicker in circumference or otherwise reinforced relative to the portions of the riser segment 22 not adjacent to the riser restraint device 44 (e.g., the upper portion 58 and the lower portion 60 of the riser segment 22). In this manner, the riser segment 22 may have a tapered main body along upper portion 58 and lower portion 60 versus middle portion 53 (e.g., the riser segment 22 may be tapered in regions not adjacent to the riser restraint device 44) in contrast to other portions of the riser 12, which may have non-tapered vertical lengths. Additionally, the upper portion 58 of the riser segment 22 may include a connector 55, such as a box connector, while the lower portion 60 of the riser segment 22 may include a connector 57, such as a pin connector.

Figure 5:
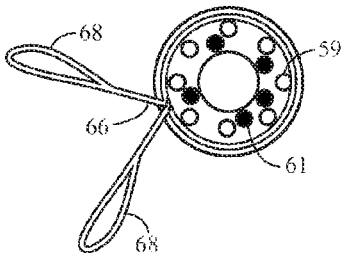
FIG. 5 illustrates a second top view of the riser restraint device 44 of FIG. 3.

As illustrated, the riser restraint device 44 may include an upper stopper 62 and a lower stopper 64 (e.g., flanges), which may operate to prevent the one or more tethers 42 from sliding vertically along riser segment 22 beyond each of the upper stopper 62 and the lower stopper 64. The riser restraint device 44 may also include one or more steel or other metallic bars 59 that operate to protect auxiliary lines 61 by preventing contact between the auxiliary line 61 and the one or more tethers 42. The riser restraint device 44 may also be a load ring that allows for free rotation in a circumferential direction about the riser segment 22 when the one or more tethers 42 are attached thereto. Alternatively, as illustrated in FIG. 5, a cable 66 may be disposed about the riser restraint device 44, whereby the cable 66 includes two loops 68 that may be connected to the tethers 42. The cable 66 of FIG. 5 may operate as a load ring, as it is able to rotate freely around the riser restraint device 44 and, thus, the riser segment 22.

Additionally, offshore vessels 10 in currents 20 typically are positioned directly into currents 20 in order to stay in position, but the offshore vessel 10 may, on occasion, be positioned at certain angle with respect to currents 20. Through the use of separate tethers 42, the ratcheting system 48 can compensate with the angle of the offshore vessel 10 by adjusting the pulling force of each respective tether 42. Moreover, it is envisioned that multiple locations of the ratcheting system 48 can be utilized. For example, one or more single ratcheting systems 48 may be at the bow, stern, port, or starboard portion of the offshore vessel 10. Likewise, two ratcheting systems 48, each tethered to the riser restraint device 44 may be positioned at the bow, stern, port, or starboard portion of the offshore vessel 10. One ratcheting system 48 may be at the bow portion while another ratcheting system 48 is at the stern portion of the offshore vessel 10 or one ratcheting system 48 may be at the port portion while another ratcheting system 48 is at the starboard portion of the offshore vessel 10 (where each of the two disposed ratcheting systems 48 controls one or two tethers 42). Similarly, four or more ratcheting systems 48 may be disposed about the offshore vessel 10 and may be used in conjunction or separate from one another based upon the currents 20 encountered.

The dimensions of the tapered riser joint 22 may be determined and generated based its specific application. Likewise, the location of riser joint 22, the tension, and/or the length of the tether 42 may be determined based on the specific application in which the offshore vessel 10 is to be deployed. The disclosed embodiments operate to mitigate riser deflection due to, for example, static current, which may, therefore, allow for the removal of or discontinued use of a dynamic control system for the offshore vessel 10. Additionally, manual adjustment of tension and/or length of tether 42 may be required in response of current 20 speed change, which may be monitored via a monitoring system of bottom angle 22 and top angle 24 equipped on the offshore vessel 10. Furthermore, as previously discussed, the proposed system for riser 12 deflection mitigation can be easily disarmed by slacking the tether 42. For example, in response emergency disconnection of the riser system, the tether 42 can be locked (fixed in length) or slacked, whichever is benefit to the riser 12 system. Each of these operations, as well as the tensioning and/or adjustment of the length of the tether 42 provided can be controlled via a control panel or remote control system of device 50 and can operate so as to not influence a procedure of emergency disconnection of riser 12.

This written description uses examples to disclose the above description, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A system, comprising:

a riser restraint device configured to be coupled to a riser of an offshore platform;

a tether configured to be coupled to the riser restraint device; and a ratcheting system configured to be coupled to the tether, wherein the riser restraint device is configured to resist movement of the riser via selective retraction and extension of the tether by the ratcheting system, wherein the riser restraint device comprises an upper stopper comprising a first aperture sized to allow an auxiliary line to pass therethrough, a lower stopper comprising a second aperture sized to allow the auxiliary line to pass therethrough, and at least one member extending between the upper stopper and the lower stopper to prevent contact between the tether and the auxiliary line, wherein the upper stopper is configured to prevent the tether from sliding vertically beyond the upper stopper and the lower stopper is configured to prevent the tether from sliding vertically beyond the lower stopper.

2. The system of claim 1, comprising a riser segment as a portion of the riser, wherein the riser segment comprises the riser restraint device.

3. The system of claim 1, wherein the tether is configured to be coupled to the riser restraint device between the upper stopper and the lower stopper.

4. The system of claim 1, comprising a cable disposed between the upper stopper and the lower stopper.

5. The system of claim 4, wherein the cable comprises a loop configured to be coupled to the tether to couple the tether to the riser restraint device.

6. The system of claim 1, wherein the riser restraint device comprises a load ring configured to rotate in a circumferential direction about the riser.

7. The system of claim 1, wherein the ratcheting system is configured to selectively retract and extend the tether based on a measurement of an angle of the riser with respect to a vertical axis.

8. The system of claim 1, wherein the ratcheting system comprises a winch.

9. A method, comprising:

disposing a riser segment onto a riser of an offshore platform, wherein the riser segment comprises a riser restraint device, wherein the riser segment comprises a reinforced portion proximate to a location of the riser restraint device to reduce stress concentrations on the riser segment due to pulling loads, wherein disposing the riser segment onto the riser comprises connecting a first connector of the riser segment to a second riser segment shaped in a physically distinct manner from the riser segment and connecting a second connector of the riser segment to a third riser segment shaped in the physically distinct manner from the riser segment;

coupling one end of a tether to the riser restraint device, wherein the tether is additionally coupled to a ratcheting system; and positioning the riser segment at a predetermined depth below the offshore platform.

10. The method of claim 9, comprising activating the ratcheting system to retract a portion of the tether into the ratcheting system to generate a predetermined tension between the tether and the riser segment.

11. The method of claim 10, comprising reactivating the ratcheting system to extend the portion of the tether from the ratcheting system to reduce the predetermined tension between the tether and the riser segment.

12. The method of claim 11, comprising activating the ratcheting system or reactivating the ratcheting system in response to a notification of an emergency disconnection of the riser from a wellhead or a blow-out preventer.

13. The method of claim 9, comprising monitoring an angle of the riser with respect to a vertical axis.

14. The method of claim 13, comprising activating the ratcheting system to retract a portion of the tether into the ratcheting system to maintain a predetermined tension between the tether and the riser segment based on the monitored angle.

15. The method of claim 13, comprising activating the ratcheting system to extend a portion of the tether from the ratcheting system to maintain a predetermined tension between the tether and the riser segment based on the monitored angle.

16. A riser segment of a riser of an offshore platform, comprising:

an upper portion of the riser segment;

a lower portion of the riser segment;

a middle portion of the riser segment disposed between the upper portion and the lower portion, wherein the middle portion is thicker in circumference than both of the upper portion and the lower portion to reinforce the riser segment against stress concentrations due to pulling loads;

a first connector configured to couple the upper portion of the riser segment to a second riser segment shaped in a physically distinct manner from the riser segment;

a second connector configured to couple the lower portion of the riser segment to a third riser segment shaped in the physically distinct manner from the riser segment; and a riser restraint device configured to receive a tether, wherein the riser restraint device is configured to operate in conjunction with the tether to resist movement of the riser segment in response to a current.

17. The riser segment of claim 16, wherein the riser restraint device is disposed in the middle portion.

18. The riser segment of claim 16, wherein the second riser segment shaped in the physically distinct manner comprises a non-tapered vertical length.

19. The riser segment of claim 16, wherein the riser restraint device comprises a bar disposed between the tether and an auxiliary line disposed vertically along the riser segment, wherein the bar is configured to prevent contact between the auxiliary line and the tether.

* * * * *